United States Patent [19]

Sparagna

[11] Patent Number: 4,963,841

[45] Date of Patent: Oct. 16, 1990

[54] DIELECTRIC RESONATOR FILTER

[75] Inventor: Stephen M. Sparagna, Milton, Mass.

[73] Assignee: Raytheon Company, Lexington, Mass.

[21] Appl. No.: 357,449

[22] Filed: May 25, 1989

[51] Int. Cl.[5] ..... H01P 1/20; H01P 7/10

[52] U.S. Cl. ..... 333/202; 333/219.1; 333/235

[58] Field of Search ..... 333/202, 219, 219.1, 333/221, 227, 229, 231, 235, 234, 206, 207, 222–224

[56] References Cited

U.S. PATENT DOCUMENTS

| | | | |
|---|---|---|---|
| 4,019,161 | 4/1977 | Kimura et al. | 333/219.1 X |
| 4,477,788 | 10/1984 | Collinet et al. | 333/235 |
| 4,484,162 | 11/1984 | Kamada et al. | 333/202 X |
| 4,630,012 | 12/1986 | Fuller et al. | 333/219.1 X |
| 4,661,790 | 4/1987 | Gannon et al. | 333/235 X |
| 4,686,496 | 8/1987 | Synett et al. | 333/219.1 X |
| 4,706,052 | 11/1987 | Hattori et al. | 333/219.1 |

FOREIGN PATENT DOCUMENTS

| | | | |
|---|---|---|---|
| 0064000 | 11/1982 | France | 333/202 |
| 0039042 | 4/1978 | Japan | 333/235 |
| 0266903 | 11/1988 | Japan | 333/219.1 |

OTHER PUBLICATIONS

D. Kajfez and P. Guillon, Dielectric Resonators, Norwood, MA: Artech House, Inc., 1986, pp. 9–15 and 26–27.

*Primary Examiner*—Eugene R. LaRoche
*Assistant Examiner*—Seung Ham
*Attorney, Agent, or Firm*—Christopher L. Maginniss; Richard M. Sharkansky

[57] ABSTRACT

A dielectric resonator filter suitable for use at L-band includes a puck-shaped dielectric resonator attached directly to a dielectric substrate which is bonded to the cavity base in order to decrease vibration sensitivity while retaining a relatively high loaded Q of the dielectric resonator filter. The high value of Q is attained by the use of a low loss dielectric substrate with a dielectric constant sufficiently high that the electrical dimensions of the cavity approximate the free space or optimum model wherein the resonator is positioned at the center of the cavity. The disclosure describes a dielectric resonator filter having a loaded Q in excess of 6500 at 1.538 GHz with an insertion loss of 6 db, while maintaining a vibration sensitivity of $2.2\times10^{-8}\,G^{-1}$. An arcuate segmented line comprising a plurality of tracks used as a coupling structure permits individual selection for each filter of the coupling, while not degrading the loaded Q value or the vibration performance.

22 Claims, 2 Drawing Sheets

DIELECTRIC RESONATOR FILTER

BACKGROUND OF THE INVENTION

The present invention relates generally to microwave circuits and, more particularly, to a dielectric resonator filter useful at L-band, the filter being structured so as to be relatively insensitive to vibration while retaining a relatively high loaded Q.

Resonators are important components in microwave radar and communication circuits. They create, filter and select frequencies in oscillators, amplifiers and tuners. Fields inside a resonator store energy at the resonant frequency where equal storage of electric and magnetic energies occurs.

The figure of merit for assessing the performance or quality of a resonator is the quality factor Q. The Q factor is a measure of energy loss or dissipation per cycle as compared to the electromagnetic energy stored in the fields inside the resonator. The Q factor of microwave devices may typically be as high as 10,000. Because the bandwidth of a resonator is inversely proportional to its Q factor, a high Q factor resonator has a narrow bandwidth.

When a resonant circuit or cavity is loaded by a microwave circuit, several different Q factors may be considered. The unloaded Q factor accounts for internal losses in the cavity or resonator itself. For cavity resonators, power loss by conductors, dielectric fills and radiation may contribute to the unloaded Q.

In order to be useful, a cavity or resonator must deliver power to an external load. The power loss due to the presence of an external load in a cavity system results in the external Q factor, which is proportional to the ratio of the energy stored inside the cavity to the external power loss drained from the internal energy reserves. The loaded quality factor is the total Q for the system including power losses both internal and external to the resonator system.

An important resonator circuit at microwave frequencies is the metal cylindrical hollow waveguide resonator. Very high Q factors and the concomitant narrow bandwidths may be achieved with this component. External circuits are coupled to the cavity through transmission line probes. The hollow cylindrical waveguide resonator has many resonance frequencies and accompanying field distributions. Electromagnetic fields can be sustained within a lossless cavity only at a resonant frequency. The resonant cavities are particularly useful as filters.

In recent years there have been increasing requirements on the performance of radar systems which have placed demands on the noise and spurious products performance of the microwave sources. The recent emphasis has been directed toward developing stable oscillators that operate at or close to the radar operating frequency. This must be done due to the noise enhancement of a source, because of multiplication to a higher frequency, and the spurious products and noise encountered by mixing to a higher frequency.

The present invention relates to a high Q dielectric resonator filter which is at the core of a low noise dielectric resonator oscillator which is phase locked to a low noise, frequency multiplied crystal source. Typically, a dielectric resonator filter includes a resonator fabricated of a material of high dielectric constant to load a cavity, thereby reducing the size of the cavity and, additionally, stabilizing the cavity, since 90 percent of the dielectric field and 65 percent of the magnetic field exist in the dielectric resonator.

According to the prior art, in order to obtain a high value of loaded Q in a dielectric resonator filter, the dielectric resonator is placed centrally within the cavity. Such positioning typically entails mounting the dielectric resonator on a pedestal fabricated of a low loss, low dielectric material in the center of the cavity. This approach approximates a free space mounting of the dielectric resonator, and the central positioning within the cavity minimizes the electric and magnetic field gradients outside the dielectric resonator, thereby reducing the losses encountered by high circulating currents in the conducting boundaries presented by the cavity.

This prior art approach, however, renders the dielectric resonator very susceptible to vibration. Mounted on a pedestal, the dielectric resonator's motion induced by shock or vibration is magnified as a load at the end of a cantilevered beam. The problem is exaggerated for a larger and more massive dielectric resonator required at L-band frequencies. The motion causes variations in the position of the dielectric resonator with respect to the walls of the cavity, which variations affect the distribution of the electric and magnetic fields in the dielectric resonator filter.

It is the need for an improved dielectric resonator filter, having a high quality factor and low insertion loss, operable at L-band, and being relatively insensitive to vibration, that provided the impetus for the present invention.

SUMMARY OF THE INVENTION

It is therefore a primary object of the present invention to provide an improved dielectric resonator filter.

It is a further object of this invention to provide a dielectric resonator filter which is an improvement over the prior art in that it has high loaded Q while maintaining a low insertion loss and low sensitivity to vibration.

It is still a further object of this invention to provide such an improved dielectric resonator filter which is operable at L-band.

These and other objects of this invention are obtained generally by providing a dielectric resonator filter comprising an electrically-conductive housing which defines a cavity therein, and a dielectric substrate bonded to an inner surface of the housing. The filter also includes terminal means coupled through the housing onto the dielectric substrate for transferring energy at a predetermined frequency into and out of the filter. Finally, the filter includes a dielectric resonator bonded directly to the dielectric substrate at a predetermined position with respect to the inner walls of the housing, wherein the bonding of the resonator to the substrate and the bonding of the substrate to the housing occur at elevated pressures so as to minimize the spacings therebetween.

In accordance with a preferred embodiment, the dielectric resonator comprises a puck-shaped object positioned centrally within a circular cavity of the housing. Additionally in accordance with a preferred embodiment, the dielectric substrate comprises a first material having a dielectric constant substantially greater than that of air, and the dielectric resonator comprises a second material having a dielectric constant substantially greater than that of the first material.

With this arrangement, the dielectric resonator may be bonded directly onto a thin substrate which itself is bonded to a surface of the cavity, wherein the relatively high dielectric constant of the substrate substantially increases its free space length, thereby allowing the resonator to be substantially electrically centered within the cavity. The direct mounting of the resonator to the thin substrate significantly reduces its susceptibility to shock and vibration of the housing.

BRIEF DESCRIPTION OF THE DRAWINGS

The foregoing features of the present invention, and the advantages thereof, may be fully understood from the following detailed description, read in conjunction with the accompanying drawings, wherein.

DESCRIPTION OF THE PREFERRED EMBODIMENTS

Figure 1:
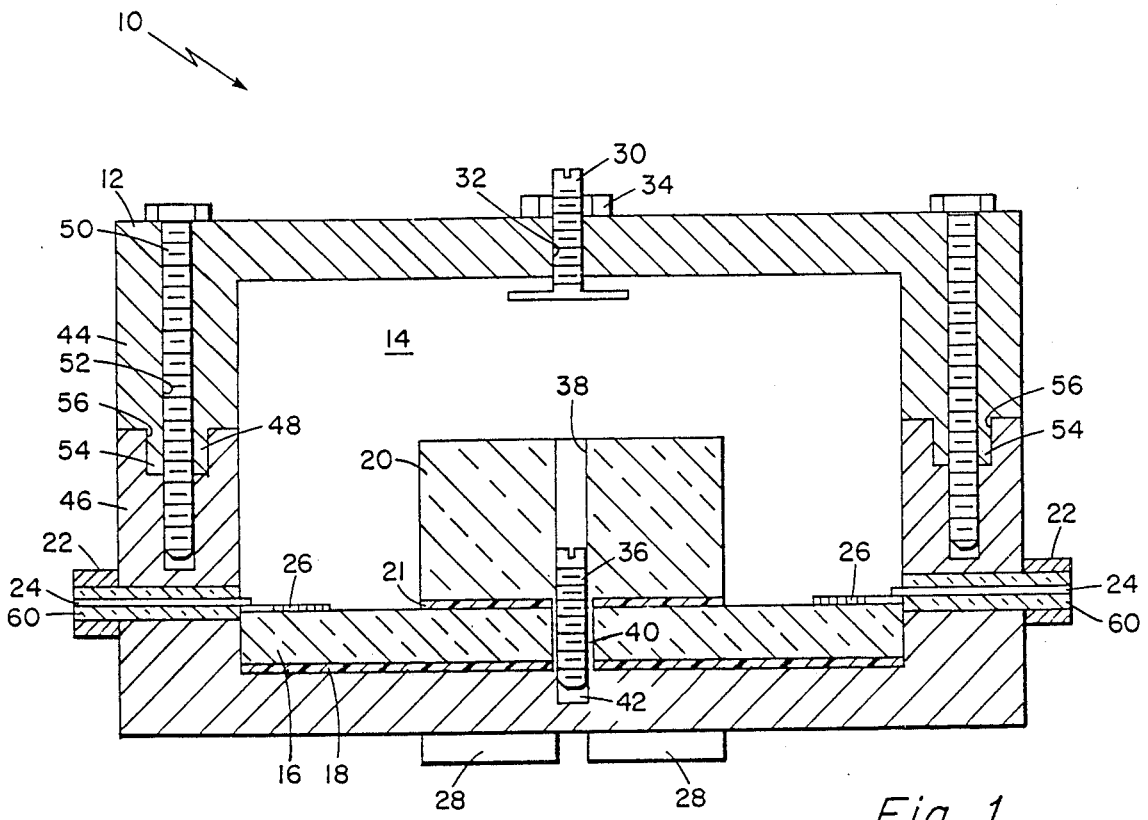
FIG. 1 is a cross-sectional view of a dielectric resonator filter according to the present invention.
Figure 2:
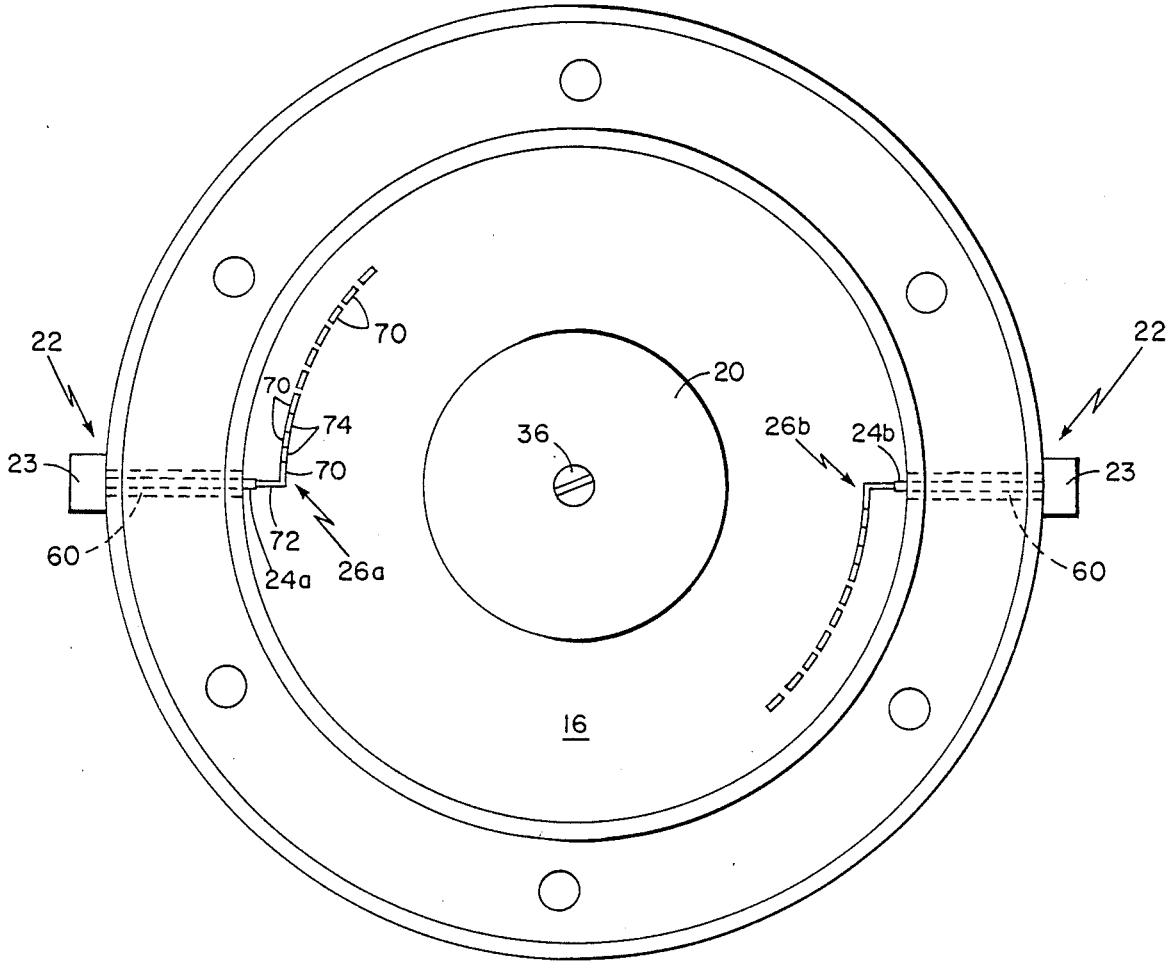
FIG. 2 is a plan view of the dielectric resonator filter of FIG. 1 in which the upper cavity housing half is removed.

Referring to FIG. 1, there is shown a cross-sectional view of a preferred embodiment of a dielectric resonator filter according to the present invention. FIG. 2 shows a cutaway plan view of the FIG. 1 embodiment. The figures are for illustrative purposes only and no relative dimensional information is to be inferred therefrom. The filter 10 comprises a metallic housing 12 defining a generally cylindrical cavity 14 therein. A substrate 16 in the form of a thin disk of dielectric material is bonded via a thin adhesive layer 18 to a flat inside surface of housing 12. A resonator 20 in the form of a puck-shaped disk fabricated of a high dielectric material is bonded via a thin adhesive layer 21 to substrate 16 and positioned substantially centrally with respect to the cylindrical inner surface of housing 12. One or more connectors 22 are coupled between the outer surface of housing 12 and substrate 16, wherein a central conductor 24 of each connector 22 is electrically coupled to a structure 26 for coupling electromagnetic energy between resonator 20 and external devices (not shown).

One or more heaters 28 affixed to an external surface of housing 12 ensure a constant operating temperature within cavity 14 over a wide range of external ambient temperature conditions. A tuning screw 30, which extends through a threaded aperture 32 in housing 12, permits small adjustments in the resonator frequency by modifying the boundary condition in the top of cavity 14. Once the proper adjustment is found, tuning screw 30 is fixed in place by a locking nut 34. A low loss plastic screw 36 extends through a threaded central aperture 38 in resonator 20, through an aperture 40 in substrate 16, and into a threaded aperture 42 in the bottom of housing 12. This screw 36 ensures correct positioning of resonator 20 with respect to the walls of cavity 14.

Considering now the structural elements of this preferred embodiment in greater detail, the present invention will be described in relation to an illustrative structure which the applicant has built and tested at L-band, more particularly, at a center frequency of 1.538 GHz, for use in a radar system.

Since the dielectric resonator is the main contributor to the loaded Q factor of a dielectric resonator filter, it is desirable to employ a device having a high dielectric constant and very high unloaded Q. In the present illustration, resonator 20 comprises zirconium-tin titanate ($(ZrSn)TiO_4$), which has a dielectric constant of 37.64. It has the shape of a puck, having a diameter of 37.7 mm and a height of approximately one-half wavelength for the particular material dielectric constant and the operating frequency of interest. Resonator 20 may illustratively be of the type sold as Part No. DRT377M060C167 by Murata Erie North America, Inc., of State College, Pa. The height of this illustrative resonator 20 is 16.7 mm; in practice, however, fine-tuning of filter 10 may include trimming the height of resonator 20 by a light sanding operation.

Resonator 20 has a threaded aperture 38 of 6 mm diameter passing from the upper to the lower surface through the center of resonator 20. This aperture 38 does not significantly affect the performance of filter 10 since the electric field strength at this location is substantially zero. Aperture 38 permits low loss plastic screw 36 to center resonator 20 within housing 12 via corresponding threaded aperture 42 in the bottom surface of housing 12. Screw 36 serves to properly position resonator 20 with respect to the walls of cavity 14. Aperture 38 in resonator 20 additionally adds to the higher mode suppression of filter 10.

Metallic housing 12 comprises an upper housing half 44 and a lower housing half 46 which are joined by a tongue-and-groove joint 48. The upper and lower housing halves 44, 46 are held together by fastening means, illustratively, six machine bolts 50 extending from upper housing half 44 into threaded apertures 52 in lower housing half 46 through tongue-and-groove joint 48. In the present example, housing 12 is fabricated of copper; however, it is recognized that alloys including invar and kovar may be alternatively used and will provide the further advantage of improved temperature stability of filter 10.

Housing 12 defines a generally cylindrical cavity 14 which, in the present example, is 38.1 mm in height and 76.2 mm in diameter. It will be noted that this cavity diameter is roughly twice the diameter of resonator 20. These dimensions provide a maximum value of loaded Q while still giving satisfactory mode separation.

Since cavity 14 determines part of the boundary conditions which establish the cavity resonant frequency, any modulation of these boundary conditions will effect a corresponding modulation of the cavity resonant frequency. While the presence of dielectric resonator 20 in cavity 14 significantly reduces this effect, as compared with an empty cavity, the effect of the modulation of the cavity dimensions on frequency is still significant enough to warrant design guidelines which minimize distortion of housing 12 as a result of shock and vibration. These design guidelines include wall thicknesses of 9.525 mm and a tongue-and-groove joint 48 at the middle of housing 12 where the upper and lower housing halves 44, 46 are joined. As shown in FIG. 1, a tenon structure 54 in upper housing 44 half mates precisely with a mortice arrangement 56 in lower housing half 46.

In the present example, heaters 28 comprise two 15 watt resistance heaters attached to the bottom outside surface of housing 12. By the use of this structural arrangement, it is a goal to achieve frequency stability within 12 KHz of the operating frequency in 30 minutes for an ambient temperature between 0° C. and 65° C.

Substrate 16, bonded between dielectric resonator 20 and the flat inner bottom surface of housing 12, comprises a thin disk of dielectric material. Its dielectric constant is substantially greater than that of air, so as to simulate an approximately central positioning of resonator 20 within cavity 14, while maintaining minimal dimensions of cavity 14. On the other hand, the dielectric constant of substrate 16 must be substantially less than that of dielectric resonator 20, so as not to compete with resonator 20. Other properties of the substrate material include a high value of Q, a coefficient of expansion close to that of dielectric resonator 20 and the ability to be easily machined and polished. In the present example, the preferred substrate is fabricated of a ceramic material, illustratively alumina, which may be of the type sold as D-MAT Grade A by Trans-Tech, Inc., Adamstown, Md. This particular material has a dielectric constant of 10.2, and a coefficient of thermal expansion of 7.2 parts per million/°C. (The illustrative material of dielectric resonator 20 has a coefficient of thermal expansion of 6.5 parts per million/°C.).

In the present example, substrate 16 has an overall diameter of 76.073 mm and a thickness of 5.08 mm. It has a central aperture 40 of 5.969 mm diameter, through which plastic screw 36 passes. The D-MAT Grade A material permits disk 16 to be polished to within one microinch and have a maximum camber of 300 μinches/inch. Furthermore, the loss tangent of this material is less than 0.0002, allowing for a loaded Q of dielectric resonator filter 10 in excess of 6500 at the frequency of interest, with an insertion loss of not greater than 6 db.

The disk thickness of 5.08 mm, in conjunction with the dielectric constant of 10.2, computes to a free space length of approximately 16.22 mm at this frequency. It will be noted that the physical positioning of dielectric resonator 20 (having a nominal thickness of 16.7 mm) on dielectric substrate 16 (having thickness of 5.08 mm) places it at a distance of 16.32 mm from the top surface of cavity 14. This distance compares favorably with the computed electrical distance between resonator 20 and bottom surface of cavity 14 of 16.22 mm, and further is roughly equivalent to the height of resonator 20. If, in fact, filter 10 is fine-tuned by trimming the top surface of resonator 20 (as suggested earlier), it may be seen that the height of resonator 20 is substantially equal to its electrical spacing between the top and bottom surfaces of cavity 14. By way of summary, it is seen that dielectric resonator 20 can be bonded in close proximity to the bottom surface of cavity 14 while being substantially electrically centered within cavity 14.

Dielectric substrate 16 is bonded to the flat inner bottom surface of housing 12 by a thin adhesive layer 18 which, in the present example, comprises a high oxide organic epoxy. This type of epoxy provides the necessary characteristics of low loss, high strength, and high rigidity. In addition, the same type of epoxy adhesive may be used to provide adhesive layer 21 which bonds dielectric resonator 20 to dielectric substrate 16.

In the present embodiment, the organic epoxy is of a type similar to type ME-868, sold by Amicon Corp., Lexington, Mass. This particular epoxy cures at 180° C. in an hour. Its Young's modulus is estimated at between $0.4\times10^6$ and $0.6\times10^6$ pounds per square inch, and its inclusion has been shown experimentally to contribute very little degradation in the form of loss to the filter performance. An additional physical property which is required of the epoxy which bonds resonator 20 to substrate 16, includes a shear modulus which is sufficiently low that it can withstand the different, albeit slight, expansion rates of the materials of resonator 20 and substrate 16, and yet is sufficiently high that it will not deleteriously affect the vibration sensitivity of filter 10.

It was seen that the epoxy layers 18, 21 bonding resonator 20 to substrate 16 and substrate 16 to housing 12 were deforming under vibration, permitting relative movement among the resonator 20, substrate 16 and housing 12. It was reasoned that a thinner bond line would allow less deformation under vibration. Accordingly, the making of filter 10 of the present invention includes curing the epoxy bonds under approximately 100 pounds per square inch. Considering the surface areas of resonator 20 and substrate 16 of the present example, this pressure is equivalent to approximately 200 pounds of force on resonator 20 and approximately 700 pounds of force on substrate 16. A filter 10 made in this manner exhibited a measured vibration sensitivity along the central axis of cavity 14 of $2.2\times10^{-8}\ G^{-1}$.

Connectors 22 each include a first, outer conductor 23, comprising an outer shell electrically coupled to housing 12, and a second, center conductor 24 passing through but electrically isolated from housing 12 via insulating sleeve 60. Two connectors are shown in the embodiments according to FIGS. 1 and 2, an input connector and an output connector; however, it will be understood by those skilled in the art that a single connector may be used for both input and output feeds. In the present example, connectors 22 are Type SMA connectors, which are well-known and widely used in microwave applications.

Referring particularly to FIG. 2, center conductors **24*a* and 24*b* are electrically connected to coupling structures 26*a* and 26*b*, respectively, which are positioned symmetrically on opposite sides about a central point on substrate 16. In the present embodiment, coupling structures 26*a* and 26*b* are identical; therefore, the description of structure 26*a* will apply equally to structure 26*b***. From the description of the coupling structure, one or more methods of fabrication of this device, using, for example, conventional photoetching techniques, will be seen to be obvious to a skilled practitioner.

Coupling structure **26*a* comprises two levels of metalization on the top side of substrate 16, i.e., on the surface adjacent resonator 20**. The first metalization layer comprises a 250 Å thickness of chromium, which acts as a barrier metal. The second layer comprises a 381 μm thickness of copper. However, the present invention is not limited to these specific metals.

Coupling structure **26*a* comprises a plurality of arcuate tracks 70 which form a segmented line, and trace wiring 72 which provides electrical connectivity between center connector 24*a* and the segmented line. In the present example, each segmented line comprises nine tracks 70 wherein each track 70 occupies four degrees of arc and the inter-track spacing is equal to one degree of arc. The arc of the segmented line is substantially concentric with the center of dielectric substrate 16 and has a radius of 31.75 mm. The width of each track 70 is 0.508 mm. Dielectric substrate 16 allows for very strong coupling to dielectric resonator 20 for small coupling structures 26*a*. Therefore, the above-mentioned track width was selected in this example in order to lower the coupling to the desired level, i.e., 6 db insertion loss, while keeping the coupling structure 26*a* at a sufficient distance from the sidewall of housing 12**.

The coupling structure 26a is arranged as a plurality of track segments in order to provide an easy method for increasing the coupling. In order to increase the coupling, successive tracks 70 are joined by soldering bridges comprising tinned copper jumpers 74 having the same width as tracks 70. Jumpers 74 are added until a desired insertion loss, close to 6 db in the present example, is obtained. Symmetry is maintained by joining an identical number of tracks 70 on both coupling structures 26a and 26b. In the illustration of FIG. 2, two jumpers 74 are shown joining three tracks 70 on both coupling structures 26a and 26b.

The properties of a dielectric resonator filter, built in accordance with the principles and methods expressed herein, permit it to have a loaded Q in excess of 6500 at 1.538 GHz with an insertion loss of 6 db, while maintaining a vibration sensitivity of $2.2\times10^{-8}$ $G^{-1}$ along the cylindrical axis of the resonator. The high value of Q is attained by the use of a low loss dielectric substrate with a dielectric constant sufficiently high that the electrical dimensions of the cavity approximate the free space or optimum model wherein the resonator is positioned at the center of the cavity. The use of the plurality of tracks as coupling structure permits individual selection for each filter of the coupling, while not degrading the loaded Q value or the vibration performance.

Figure 3:
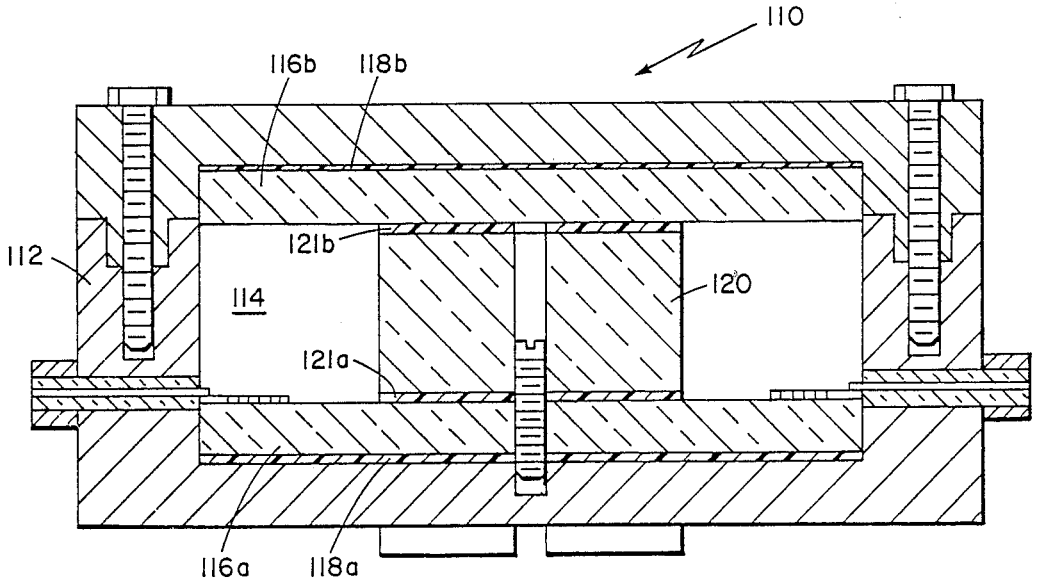
FIG. 3 is a cross-sectional view of a second embodiment of a dielectric resonator according to the present invention.

Referring now to FIG. 3, there is shown a dielectric resonator filter 110 according to a second embodiment of the present invention. Filter 110 comprises a metallic housing 112 defining a generally cylindrical cavity 114 therein. Substrates 116a and 116b in the form of thin disks of dielectric material are respectively bonded via thin adhesive layers 118a and 118b to the top and bottom inside surfaces of housing 112. A resonator 120 in the form of a puck-shaped disk fabricated of a high dielectric material is bonded via thin adhesive layers 121a and 121b, respectively to substrates 116a and 116b, and is positioned substantially centrally with respect to the cylindrical inner surface of the housing 112.

The thicknesses and dielectric constants of the material comprising the upper and lower substrates 116a, 116b are chosen such that, at the frequency of interest, dielectric resonator 120 is substantially electrically centered between the top and bottom surfaces of cavity 114, and furthermore, such that the electrical lengths of the top and bottom substrates 116a, 116b are substantially equal to the height of dielectric resonator 120. This embodiment provides advantages over the embodiment illustrated in FIG. 1 in that a smaller cavity is required and a more rigid mounting of the dielectric resonator is possible. However, this approach precludes the use of tuning screw 50 of the FIG. 1 embodiment by which the boundary conditions of cavity 14 may be fine-tuned.

While the principles of the present invention have been demonstrated with particular regard t the illustrated structure of the figures, it will be recognized that various departures from such illustrative structure may be undertaken in the practice of the invention. The scope of this invention is not intended to be limited to the structure disclosed herein but should instead be gauged by the breadth of the claims which follow.

What is claimed is:

1. A dielectric resonator filter comprising:

an electrically-conductive housing which defines a cavity therein;

a dielectric substrate bonded to an inner surface of said housing;

terminal means coupled through said housing onto said dielectric substrate for transferring energy at a predetermined frequency into and out of said filter;

a coupling structure on a surface of said dielectric substrate, said coupling structure coupled at one end thereof to said terminal means, said coupling structure comprising a plurality of electrically-conductive tracks forming an arcuate segmented line, said arcuate segmented line being substantially concentric with the center of said dielectric substrate; and a dielectric resonator bonded directly to said dielectric substrate at a predetermined position with respect to the cavity walls of said housing, wherein the bonding of said resonator to said substrate and said substrate to said housing occurs at elevated pressure to minimize the spacings therebetween.

2. The filter according to claim 1 wherein said housing comprises upper and lower mating halves.

3. The filter according to claim 2 wherein said upper and lower halves mate at a tongue-and-groove joint.

4. The filter according to claim 1 wherein said housing further includes a tuning screw for adjusting the boundary conditions of said cavity.

5. The filter according to claim 1 wherein said housing comprises copper.

6. The filter according to claim 1 wherein said cavity has top and bottom surfaces and a generally cylindrical side wall.

7. The filter according to claim 6 wherein said dielectric substrate comprises a thin disk covering substantially the entire bottom surface of said cavity.

8. The filter according to claim 1 wherein said terminal means comprises two connectors.

9. The filter according to claim 1 wherein said electrically conductive tracks comprise a layer of copper overlying a metalization layer comprising chromium.

10. The filter according to claim 1 wherein said dielectric resonator comprises a cylindrical structure.

11. The filter according to claim 6 wherein said dielectric resonator is positioned substantially centrally within the cylinder of said cavity.

12. The filter according to claim 1 wherein the material of said dielectric substrate has a dielectric constant substantially greater than that of air.

13. The filter according to claim 12 wherein the dielectric constant of said substrate is approximately ten.

14. The filter according to claim 12 wherein the material of said dielectric resonator has a dielectric constant substantially greater than the dielectric constant of said dielectric substrate.

15. The filter according to claim 14 wherein the dielectric constant of said resonator is approximately 38 and the dielectric constant of said substrate is approximately ten.

16. The filter according to claim 7 wherein said dielectric substrate is selected to provide an electrical length at said predetermined frequency such that said dielectric resonator is substantially electrically centered between said top and bottom surfaces of said cavity.

17. The filter according to claim 1 wherein said dielectric resonator is bonded to said dielectric substrate and said dielectric substrate is bonded to said housing by an epoxy adhesive.

18. The filter according to claim 17 wherein said epoxy adhesive is oxide filled.

19. The filter according to claim 17 wherein the curing of said epoxy adhesive bonding said dielectric resonator to said dielectric substrate and said dielectric substrate to said housing occurs at a pressure of substantially 100 pounds per square inch.

20. A dielectric resonator filter comprising:

an electrically-conductive housing which defines a cavity therein;

a dielectric substrate bonded to an inner surface of said housing;

terminal means coupled through said housing onto said dielectric substrate for transferring energy at a predetermined frequency into and out of said filter;

a coupling structure on a surface of said dielectric substrate, said coupling structure coupled at one end thereof to said terminal means, said coupling structure comprising a plurality of electrically-conductive tracks forming an arcuate segmented line, said arcuate segmented line being substantially concentric with the center of said dielectric substrate;

a dielectric resonator; and adhesive means for bonding said dielectric resonator directly to said dielectric substrate at a predetermined position with respect to the cavity walls of said housing, said adhesive means providing a sufficiently rigid bond between said dielectric resonator and said dielectric substrate so as to maintain said dielectric resonator in substantially said predetermined position during vibration of said housing.

21. A dielectric resonator filter comprising:

an electrically-conductive housing which defines a cavity therein, said cavity having top and bottom surfaces and a generally cylindrical side wall;

a dielectric substrate bonded to and covering substantially the entire bottom surface of said cavity;

terminal means coupled through said housing onto said dielectric substrate for transferring energy at a predetermined frequency into and out of said filter;

a coupling structure on a surface of said dielectric substrate, said coupling structure coupled at one end thereof to said terminal means, said coupling structure comprising a plurality of electrically-conductive tracks forming an arcuate segmented line, said arcuate segmented line being substantially concentric with the center of said dielectric substrate; and a dielectric resonator bonded directly to said dielectric substrate at a predetermined position with respect to said side wall of said cavity, wherein said dielectric substrate is selected to provide an electrical length at said predetermined frequency such that said resonator is substantially electrically centered between said top and bottom surfaces of said cavity.

22. A dielectric resonator filter comprising:

an electrically-conductive housing which defines a cavity therein, said cavity having top and bottom surfaces and a generally cylindrical side wall;

a first dielectric substrate bonded to and covering substantially the entire bottom surface of said cavity;

a second dielectric substrate bonded to and covering substantially the entire top surface of said cavity;

terminal means coupled through said housing onto one of said dielectric substrates for transferring energy at a predetermined frequency into and out of said filter;

a coupling structure on a surface of said dielectric substrate, said coupling structure coupled at one end thereof to said terminal means, said coupling structure comprising a plurality of electrically-conductive tracks forming an arcuate segmented line, said arcuate segmented line being substantially concentric with the center of said dielectric substrate; and a dielectric resonator having a generally cylindrical shape, said resonator bonded at its bottom surface to said first dielectric substrate and bonded at its top surface to said second dielectric substrate, said dielectric resonator being located at a predetermined position with respect to said side wall of said cavity, wherein said first and second dielectric substrates are selected to provide electrical lengths at said predetermined frequency such that said resonator is substantially electrically centered between said top and bottom surfaces of said cavity, said electrical lengths being approximately equal to each other and approximately equal to the height of said resonator.

* * * * *